US005139291A

United States Patent [19]

Schultz

[11] Patent Number: 5,139,291

[45] Date of Patent: Aug. 18, 1992

[54] FLUSH MOUNT TILT-LATCH FOR A SASH WINDOW AND METHOD

[75] Inventor: Steven E. Schultz, Orland Park, Ill.

[73] Assignee: Ashland Products, Inc., Chicago, Ill.

[21] Appl. No.: 784,387

[22] Filed: Oct. 29, 1991

[51] Int. Cl.[5] ..... E05C 1/10

[52] U.S. Cl. ..... 292/42; 292/337; 292/DIG. 53

[58] Field of Search ..... 292/42, 175, 137, 145, 292/DIG. 53, DIG. 64, 337

[56] References Cited

U.S. PATENT DOCUMENTS

| | | | |
|---|---|---|---|
| 4,475,311 | 10/1984 | Gibson | 49/176 |
| 4,553,353 | 11/1985 | Simpson | 49/161 |
| 4,578,903 | 4/1986 | Simpson | 49/175 |
| 4,622,778 | 11/1986 | Simpson | 49/161 |
| 4,669,765 | 6/1987 | Ullman | 49/153 |
| 4,790,579 | 12/1988 | Maxwell et al. | 292/175 |
| 4,791,756 | 12/1988 | Simpson | 49/175 |
| 4,824,154 | 4/1989 | Simpson | 292/338 |
| 4,837,975 | 6/1989 | Simpson | 49/175 |
| 4,901,475 | 2/1990 | Simpson | 49/175 |
| 5,028,083 | 7/1991 | Mischenko | 292/175 |

*Primary Examiner*—Richard E. Moore
*Attorney, Agent, or Firm*—Wallenstein, Wagner & Hattis, Ltd.

[57] ABSTRACT

A pivot latch adapted for releasably securing a pivotable sash window to a master frame. The master frame has opposed, vertically extending guide rails. The sash has a hollow top sash rail, a base and a pair of hollow stiles cooperatively connected together at adjacent extremities thereof to form a rectangular sash frame. The top sash rail includes a pair of opposing header slots. Each of the header slots forms a pair of opposing, longitudinal header rails. The pivot latch comprises a housing having an outward end opening. A latch bolt is disposed within the housing. The pivot latch further includes a spring for biasing the latch bolt outwardly through the outward end opening and is adapted for engaging one of the guide rails. The housing has a cover having longitudinal edges and a pair of side walls depending from the cover and disposed inward of the edges. Each of the side walls has a side wall rail which cooperates with a respective one of the housing cover edges to form a longitudinal groove adapted to cooperatively receive a respective pair of the header rails. A tab depending from the housing is provided for engaging a respective one of the stiles to retain the tilt latch in position.

A method of manufacturing a pivotable sash window including such a pivot latch is also disclosed.

17 Claims, 2 Drawing Sheets

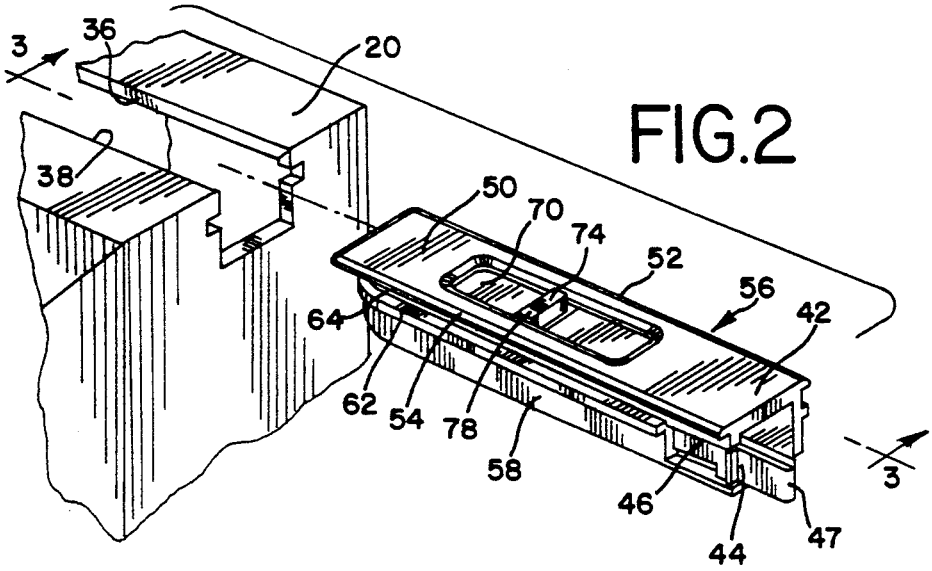
FIG.2
FIG. 3
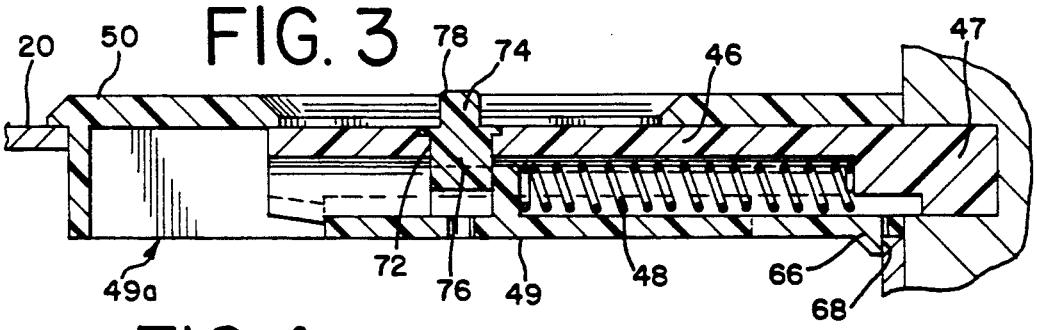
FIG.4
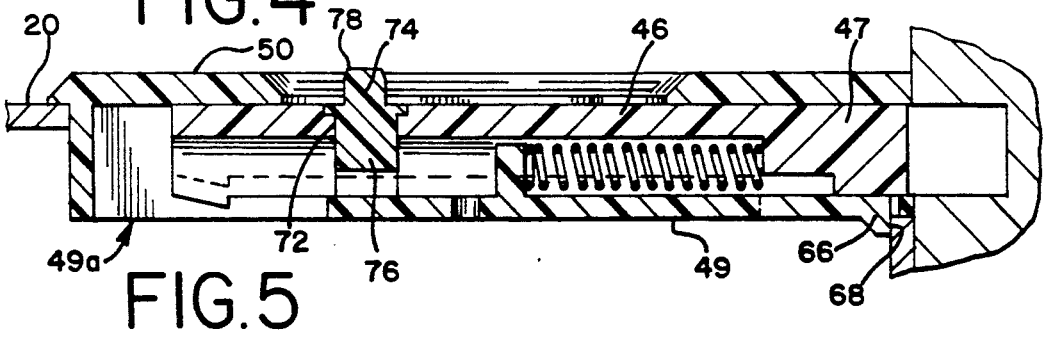
FIG.5
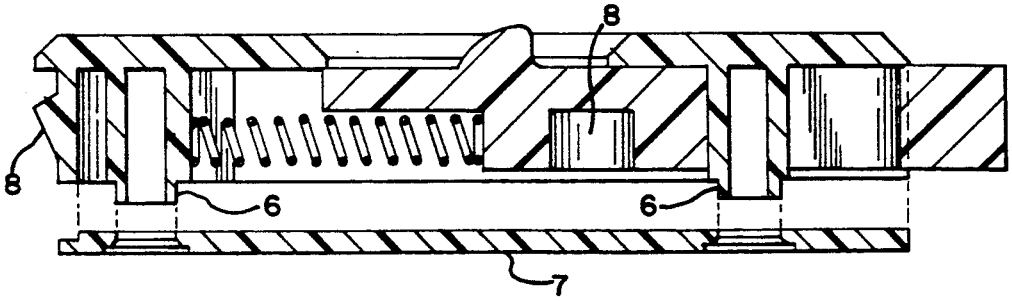

FLUSH MOUNT TILT-LATCH FOR A SASH WINDOW AND METHOD

DESCRIPTION

1. Technical Field

The invention relates to a pivotable sash window and more particularly, to an easily installed, flush mounted pivot latch therefor.

2. Background Prior Art

A pivotal window sash adapted for installation in a master frame of a sash window assembly is well known. The sash window assembly typically has opposed, vertically extending guide rails to enable vertical reciprocal sliding movement of the sash window in the master frame while cooperatively engaged with the guide rails. The sash window has a top sash, a base and a pair of stiles cooperatively connected together at adjacent extremities thereof to form a rectangular sash frame. Typically, a pair spaced pivot latches are installed on, or in, opposite ends of the top sash.

Each of the pivot latches typically includes a housing having an outward end opening and a latch bolt disposed within said housing. A spring disposed within the housing biases the latch bolt outwardly through the outward end opening to engage the guide rails. A control button is coupled to the latch bolt and extends upwardly through an elongated opening in the upper surface of the housing. The control button permits selective inward movement of the latch bolt to release the latch bolt from the respective guide rail.

Certain pivot latches have been surface mounted on the top sash, such as shown in U.S. Pat. Nos. 4,837,975 and 4,901,475, assigned to Ashland Products of Chicago, Ill., assignee of this patent application. Such surface mounted pivot latches have worked well, but are not considered aesthetically pleasing in certain applications. Additionally, there is a tendency for the surface mounted latches to fail following repeated collisions with the header of the window frame.

Other pivot latches have been mounted substantially within the top sash. Certain of these pivot latches, often referred to as flush mounted pivot latches, are disclosed in U.S. Pat. Nos. 4,553,353; 4,578,903; 4,622,778; and 4,791,756, also assigned to Ashland Products. While these too have worked well with respect to aesthetics, they have been relatively difficult to assemble and install.

Ro-Mai Industries, Inc., of Twinsburg, Ohio, has recently begun selling a flush mounted pivot latch for insertion in a hollow top sash of a sash window, as illustrated in FIG. 5. A slot is formed in each of the outer ends of the hollow top sash. The pivot latch has depending sidewalls. However, because the sidewalls are relatively thin, a pair of bosses 6 are required to provide a sufficiently stable surface to which to heat-stake a base 7. Flared tabs 8 are provided which extend outwardly from the sidewalls and the rear wall. The pivot latch is installed in the top sash by pushing it downwardly into the respective top sash slot until the tabs retainingly catch the top sash. A bump disposed on the base of the pivot latch reduces lateral movement of the pivot latch. This pivot latch too is difficult to assemble and tends to disengage from the sash.

The present invention is provided to solve these and other problems.

SUMMARY OF THE INVENTION

It is an object of the invention to provide a substantially flush mounted pivot latch adapted for releasably securing a pivotable sash window to a master frame.

The master frame has opposed, vertically extending guide rails. The sash has a hollow top sash, a base and a pair of hollow stiles cooperatively connected together at adjacent extremities thereof to form a rectangular sash frame. The top sash includes a pair of opposing header slots. Each of the header slots form a pair of opposing, longitudinal header rails.

In accordance with the invention, the pivot latch comprises a housing having an outward end opening. In the preferred embodiment, the housing is one-piece. A latch bolt is disposed within the housing and has a nose portion, typically beveled. A spring biases the latch bolt outwardly through the outward end opening to cause the nose portion to engage one of the guide rails. The housing has a cover having longitudinal edges and a pair of side walls depending from the cover. The side walls are disposed inward of the edges. Each of the side walls has a side wall rail which cooperates with a respective one of the housing cover edges to form a longitudinal groove adapted to cooperatively receive a respective pair of the header rails. The housing includes a depending tab for engaging a respective one of the stiles.

The invention further comprehends a method of manufacturing a pivotable sash window having a pivot latch adapted for releasably securing the pivotable sash window to the master frame.

In accordance with this aspect of the invention, the method comprises the steps of providing a sash window having a hollow top sash, a base and a pair of hollow stiles cooperatively connected together at adjacent extremities thereof to form a rectangular sash frame, and forming a pair of opposing header slots in the top sash inwardly from each end thereof. The header slots may be formed by routing, prepunching, or the like. Each of the header slots has a pair of opposing, longitudinal header rails. The method further includes the steps of providing a pair of pivot latches. Each of the pivot latches comprises a housing having an outward end opening, and a latch bolt biased outwardly through the outward end opening. The housing has a cover having longitudinal edges and a pair of side walls depending from the cover and disposed inward of the edges. Each of the side walls has a side wall rail which cooperates with a respective one of the housing cover edges to form a longitudinal groove. One of the pivot latches is inserted in each of the header slots, such that the longitudinal groove cooperatively receives a respective pair of the header rails.

A tab depending from a the base of the housing is provided, and the latch is inserted until the respective engaging means has engaged the respective one of the stiles.

Other features and advantages of the invention will be apparent from the following specification taken in conjunction with the following drawing.

BRIEF DESCRIPTION OF DRAWINGS

FIG. 2 is a perspective view of the pivot latch of FIG. 1;

FIG. 3 is a sectional view of the pivot latch of F 2 taken along line 3—3 thereof, the pivot latch being shown with the latch bolt in the extended position;

FIG. 4 is a sectional view of the pivot latch of FIG. 2 taken along line 3—3 thereof, the pivot latch being shown with the latch bolt in the retracted position; and FIG. 5 is a sectional view of a prior art pivot latch.

DETAILED DESCRIPTION

Figure 1:
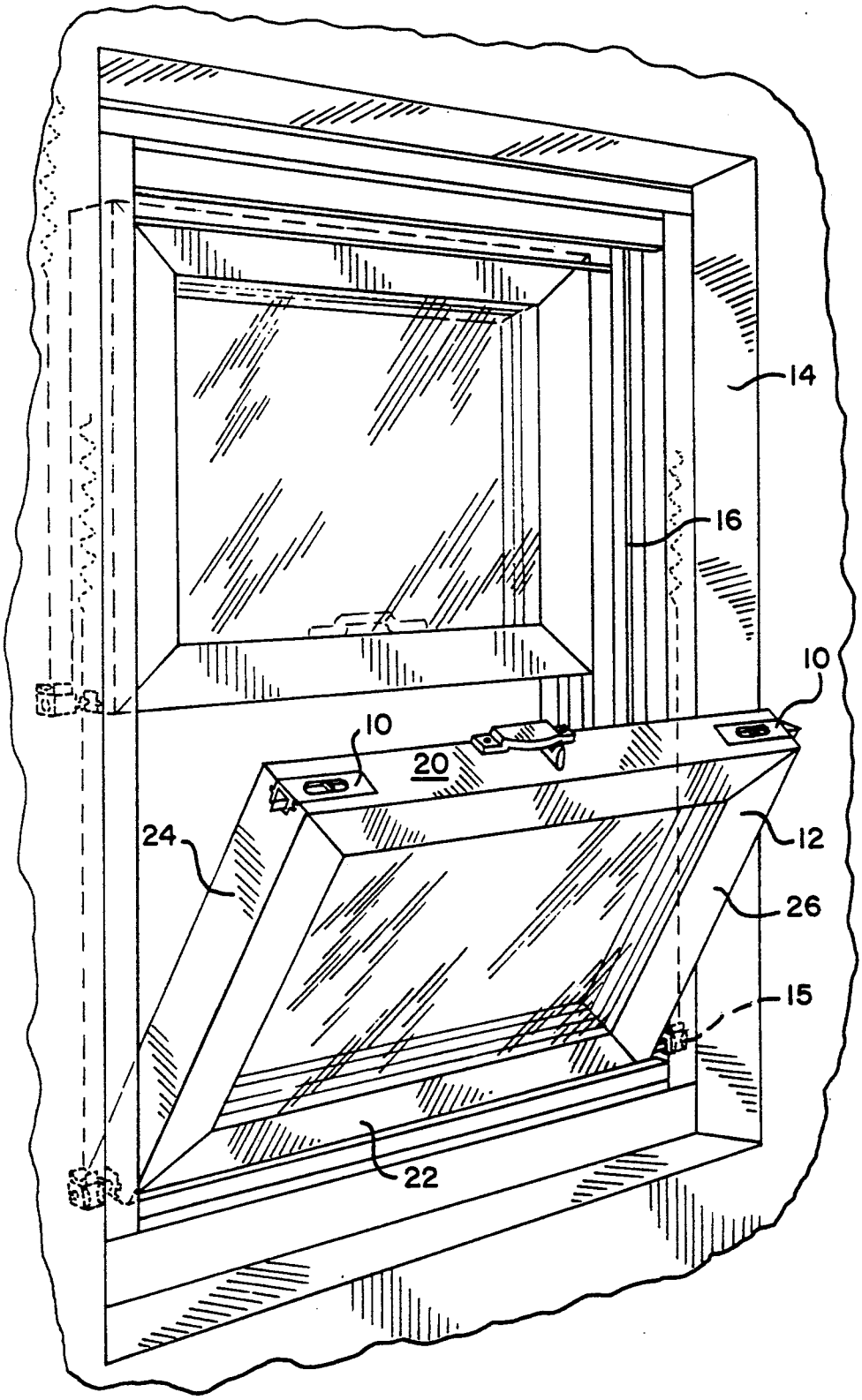
FIG. 1 is a perspective view of a double hung sash window utilizing a pivot latch according to the invention.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

A pivot latch 10 adapted for releasably securing a pivotable sash window 12 to a master frame 14 is illustrated in FIG. 1. The sash window 12 is pivotally mounted to the master frame 14 by a pivot latch assembly 15. The pivot latch assembly 15 is described in greater detail in co-pending application Ser. No. 07/770,182 entitled "Pivot Corner for a Sash Window", assigned to Ashland Products, the assignee to this application. The specification of co-pending application Ser. No. 07/770,182 is expressly incorporated herein.

As is well known, the master frame 14 has opposed, vertically extending guide rails 16. The sash window 12 has a hollow top sash rail 20, a base 22 and a pair of hollow stiles 24,26, cooperatively connected together at adjacent extremities thereof to form a rectangular sash frame.

Referring to FIGS. 2, 3 and 4, the top sash rail 20 includes a pair of opposing header slots 34 (one shown), which were formed as by routing the hollow top sash rail 20. Alternatively, the header slots 34 may be formed by prepunching the top sash rail 20. Each of the header slots 34 forms a pair of opposing, longitudinal header rails 36,38.

The pivot latch 10 is formed of strong synthetic resin, such as nylon. In heavy duty applications, 30% glass filled nylon may be used. Other materials could be substituted.

The pivot latch 10 comprises a housing 42 having an outward end opening 44. The housing 42 is of one-piece construction. The one-piece construction strengthens the housing 42 and simplifies assembly. A latch bolt 46 is disposed within the housing 42 and preferably has a beveled nose portion 47 to permit pivotal slamming of the sash window 12. A spring 48 biases the latch bolt 46 outwardly through the outward end opening 44, and the nose portion 47 is adapted for engaging its respective one of the guide rails 16. A base portion 49 of the housing 42 maintains the spring 48 and the latch bolt 46 in place. The base portion 49 does not extend the entire length of the housing 42, thus providing an assembly opening **49*a*, to permit assembly of the pivot latch 10**, discussed below.

The housing 42 has a cover portion 50 having opposing longitudinal edges 52,54. A pair of side walls 56,58, depend from the cover 50, and in the preferred embodiment are spaced inward of the respective longitudinal edges 52,54. Each of the side walls 56,58, has a side wall rail 62 which cooperates with a respective one of the housing cover longitudinal edges 52,54, to form a longitudinal groove 64 adapted to cooperatively receive a respective one of the header rails 36,38. The housing 42 also includes a depending tab 66 for engaging the inner surface 68 a respective one of the stiles 24,26.

Each of the pivot latches 10 is inserted from the side into a respective one of the header slots 34, such that the pair of longitudinal grooves 64 cooperatively receives a respective pair of the header rails 36,38. The pivot latch 10 is inserted a distance until the depending tab 66 has engaged the inner surface 68 of a respective one of the stiles 24,26.

The cover portion 50 of the housing 42 has an elongated opening 70. The latch bolt 46 includes a transverse slot 72. A control button 74 has a first end 76 securely received within the slot 72 and a second end 78 extending away from the slot 72 and outwardly through the elongated opening 70. The control button 74 entirely fills the slot 72, to prevent deflection of the latch bolt 46 when depressing the control button 74. Alternatively, the slot 72 could be enlarged, and the control button 74 eliminated, to permit an operator's finger to directly retract the latch bolt 46. A lock button, such as disclosed in allowed patent application Ser. No. 07/687,833, could also be incorporated, if desired.

The pivot latch is also easily preassembled by inserting the latch bolt 46 and the spring 48 in place via the assembly opening **49*a*. The first end 76 of the control button 74 is then inserted through the elongated opening 70 and into the slot 72**.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. For a pivotal window sash adapted for installation in a master frame of a sash window assembly having opposed, vertically extending guide rails to enable vertical reciprocal sliding movement of said sash window in said master frame while cooperatively engaged with said guide rails, said window sash having a top sash rail, a base and a pair of stiles cooperatively connected together at adjacent extremities thereof to form a rectangular sash frame, said top sash rail including a pair of opposing header slots, each of said header slots having a pair of opposing, longitudinal header rails, a preassembled pivot latch adapted for substantially flush installation in one of said header slots for releasably securing said window sash to said master frame to permit pivotal movement of said sash, said latch comprising:

a housing having an outward end opening;

a latch bolt disposed within said housing;

means for biasing said latch bolt outwardly through said outward end opening and having a nose portion adapted for engaging a respective one of said guide rails, wherein said housing has a cover and a pair of side walls depending from said cover, each of said side walls forming a longitudinal groove adapted to cooperatively receive a respective pair of said header rails, said housing further including means for engaging said respective one of said stiles.

2. The structure of claim 1 wherein said biasing means comprises a spring.

3. The structure of claim 1 wherein said stile engaging means comprises a tab depending from said housing.

4. The structure of claim 1 wherein said latch bolt nose portion is beveled.

5. The structure of claim 1 wherein:

said housing includes a cover having an elongated opening; and said latch bolt includes a slot, said pivot latch further including a control button having a first end securely received within said slot and having a second end extending away from said slot and outwardly through said elongated opening.

6. The structure of claim 5 wherein said control button first end entirely fills said slot.

7. A pivot latch adapted for releasably securing a pivotable sash window to a master frame, said master frame having opposed, vertically extending guide rails, said sash having a hollow top sash rail, a base and a pair of hollow stiles cooperatively connected together at adjacent extremities thereof to form a rectangular sash frame, said top sash rail including a pair of opposing header slots, each of said header slots forming a pair of opposing, longitudinal header rails, said pivot latch comprising:

a housing having an outward end opening;

a latch bolt disposed within said housing;

means for biasing said latch bolt outwardly through said outward end opening and adapted for engaging a respective one of said guide rails, wherein said housing has a cover having longitudinal edges and a pair of side walls depending from said cover and disposed inward of said edges, each of said side walls having a side wall rail which cooperates with a respective one of said housing cover edges to form a longitudinal groove adapted to cooperatively receive a respective pair of said header rails.

8. The structure of claim 7, wherein said housing includes means for engaging a respective one of said stiles.

9. The structure of claim 8 wherein said stile engaging means comprises a tab depending from said housing.

10. The structure of claim 7 wherein said housing is of one-piece construction.

11. The structure of claim 7 wherein:

said housing includes a cover having an elongated opening; and said latch bolt includes a slot, said pivot latch further including a control button having a first end securely received within said slot and having a second end extending away from said slot and outwardly through said elongated opening.

12. The structure of claim 11 wherein said control button entirely fills said slot.

13. A method of manufacturing a pivotable sash window having a pivot latch adapted for releasably securing said pivotable sash window to a master frame, said master frame having opposed, vertically extending guide rails, said method comprising the steps of:

providing a sash window having a hollow top sash rail, a base and a pair of hollow stiles cooperatively connected together at adjacent extremities thereof to form a rectangular sash frame;

forming a pair of opposing header slots, each of said header slots having a pair of opposing, longitudinal header rails;

providing a pair of pivot latches, each of said pivot latches comprising a housing having an outward end opening, and a latch bolt biased outwardly through said outward end opening, wherein said housing has a cover portion having longitudinal edges and a pair of side walls depending from said cover portion and disposed inward of said edges, each of said side walls having a side wall rail which cooperates with a respective one of said housing cover edges to form a longitudinal groove; and inserting one of said pivot latches in each of said header slots such that said longitudinal groove cooperatively receives a respective pair of said header rails.

14. The method of claim 13 wherein said header slots are formed by routing said top sash rail.

15. The method of claim 14 wherein said header slots are formed by prepunching said top sash rail.

16. The method of claim 13 including the steps of:

providing a means disposed on said housing for engaging a respective one of said stiles; and inserting said pivot latches until said respective engaging means has engaged said respective one of said stiles.

17. The pivot latch of claim 16 wherein said stile engaging means comprises a tab depending from said housing.

* * * * *